United States Patent [19]

Stockton

[11] 4,405,288

[45] Sep. 20, 1983

[54] VARIABLE DISPLACEMENT HYDRAULIC PUMP AND CONTROLS THEREFOR

[75] Inventor: Thomas R. Stockton, Ann Arbor, Mich.

[73] Assignee: Ford Motor Company, Dearborn, Mich.

[21] Appl. No.: 126,924

[22] Filed: Mar. 3, 1980

[51] Int. Cl.[3] ..... F04B 49/00

[52] U.S. Cl. ..... 417/220; 60/450

[58] Field of Search ..... 91/496, 497, 498; 417/218, 219, 220, 221; 60/445, 450, 452

[56] References Cited

U.S. PATENT DOCUMENTS

| | | | |
|---|---|---|---|
| 1,987,781 | 1/1935 | Maw | 91/498 |
| 2,238,061 | 4/1941 | Kendrick | 60/450 |
| 2,288,833 | 7/1942 | Pascoe | 91/497 X |
| 2,562,615 | 7/1951 | Huber | 60/450 X |
| 3,067,693 | 12/1962 | Lambeck | 417/219 |
| 3,259,074 | 7/1966 | Erdmann | 417/273 |
| 3,593,621 | 7/1971 | Praddaude | 91/498 |

FOREIGN PATENT DOCUMENTS

| | | | |
|---|---|---|---|
| 2436627 | 2/1976 | Fed. Rep. of Germany | 91/491 |

*Primary Examiner*—Carlton R. Croyle
*Assistant Examiner*—Edward Look
*Attorney, Agent, or Firm*—Frank G. McKenzie; Donald G. Harrington

[57] ABSTRACT

A variable displacement rotary piston pump has a rotor splined to a driven shaft, a plurality of radially directed cylinders, each having a slidable piston fitted therein, a pumping ring surrounding the rotor and mounted eccentrically of the axis of the rotor with which the pistons maintain contact and are caused to move within the cylinders, a piston return ring engageable with notches formed on the pistons and an eccentric mounted for rotation to which the pumping ring is secured having an actuator pin whose movement determines the position of the pumping ring with respect to the rotor, thereby regulating the flow rate of the pump. The pump destrokes above the idle speed of the engine from which it is driven and limits the flow rate of the pump. A venturi orifice establishes a differential pressure which is applied across a flow control valve, which directs hydraulic fluid at discharge pressure to one or the other of two control pistons thereby adjusting the eccentric position. A left- right turn valve adapts the pump for use in a power steering system in a motor vehicle. A cam follower compresses fluid which is metered to the flow control valve and direct hydraulic fluid at discharge pressure to the left and right ends of a power steering cylinder.

5 Claims, 7 Drawing Figures

VARIABLE DISPLACEMENT HYDRAULIC PUMP AND CONTROLS THEREFOR

BACKGROUND OF THE INVENTION

1. Field of the Invention

This invention relates to a variable displacement rotary piston pump and the hydraulic controls therefor. More particularly, my invention pertains to a servo control that limits the flow rate of the pump to a value corresponding to a predetermined differential pressure across a venturi orifice. A second control regulates the pump volume to a minimum flow rate and pressurizes the hydraulic system when a valve spool is rotated. This produces a control pressure that is balanced against the pump discharge pressure and operates to regulate the volumetric capacity of the pump.

2. Description of the Prior Art

A radial piston pump is a hydraulic device in which several pistons slidable radially within the cylinders of the rotor are caused to reciprocate as the rotor turns by being held in contact with a cam or pumping ring. The ring is mounted eccentrically of the rotor axis. By varying the amount of eccentricity, the flow rate of the pump can be made to vary.

Generally, variable displacement radial piston pumps have the pumping ring mounted on bearings at opposite sides of the rotor in a so-called straddle mounted position. This method of support for the pumping ring is well known from the prior art and is shown and described in the following U.S. Pat. Nos. 3,708,250, 3,758,899, and 4,056,042. One difficulty with the straddle mounted design involves the need for excessively large control system friction forces that result when the slide block is moved to create the eccentricity of a caged pumping ring. It is preferable to reduce the inherent frictional forces resulting from the control system so that the operating efficiency of the pump can be increased. Hydraulic controls for rotary vane and piston pumps are known in the prior art and generally provide for the pump to discharge pressure to operate a servo hydraulic control that varies the eccentricity of the pumping ring. Typical examples of this kind of control are shown in U.S. Pat. Nos. 2,462,725 and 3,796,052.

SUMMARY OF THE INVENTION

The variable displacement rotary piston pump of this invention provides control surfaces within the pump that determine the pump displacement and operate with substantially lower frictional losses than is possible with conventional mechanical controls. This object is realized by providing a pumping ring that overhangs the rotor and which is mounted at one axial end only on anti-friction bearings as distinguished from the straddle mounted pumping rings of conventional design practice. The overhung mounting of the pumping ring permits variable pump displacement by rotating an eccentric as distinguished from the slide block construction of a caged pumping ring.

The pump is adapted to operate at low rotor speed, for example, when it is driven by an internal combustion engine at idle speed. The problems associated with driving the pistons outwardly during the suction stroke is overcome without the need for mechanical springs or the need to rely on the variable and often insufficient magnitude of centrifugal force to maintain this contact. My pump overcomes this difficulty by including a piston return ring that seats in notches formed on the cylindrical surfaces of each piston. When the piston are forced inwardly due to the eccentric position of pumping ring, that inward motion is transmitted across the rotor axis to the pistons that are in the suction portion of the rotor cycle causing those pistons to be moved outwardly within the cylinders and into continual contact with the pumping ring.

Frictional loss associated with the mechanical components that control volumetric displacement of the pump is minimized because the sliding motion between the pistons and the suction ring and also between the pistons and the pumping ring is limited. Only incremental tangential differences in the velocity exist among these members. The suction ring actually floats on supporting thicknesses of hydraulic fluid within the pump casing without the support of bearings and attains a free rotational speed approximately equal to the rotor speed.

The characteristic problems of wear in pumps of this kind is reduced further by a second function of the piston return or suction ring that prevents the pistons from rotating within the cylinders by reason of the engagement of the suction ring with the notches of each piston. The contour of the outermost end of each piston is cylindrical and conforms closely to the surface of the pumping ring with which each piston maintains contact. In this way, contact stresses are minimized and wear is reduced accordingly.

A hydraulic control is described that causes the pump to destroke when the rotor speed exceeds the idle speed of the prime mover. This limits the flow rate of the pump to a predetermined magnitude that corresponds to the minimum flow rate required by the hydraulic system it pressurizes. In this way the pumping losses associated with a pump flow rate that exceeds the requirements of the hydraulic system that are typically produced when the rotor operates at high speed, are minimized. This objective is realized by a servo control through the use of a venturi orifice that establishes a differential pressure corresponding to the requisite flow rate of the hydraulic system. If pump displacement falls below the hydraulic system requirements, this control causes a piston to rotate an eccentric thereby placing the pumping ring in an eccentric position thus increasing pump stroke. If the flow rate exceeds the requirements of the system, the control operates to force the pumping ring to a more concentric position thereby causing the pump to destroke and the flow rate to be reduced.

A second control, suitable for use with a hydraulically operated power steering system for a motor vehicle, regulates the control pressure to correspond with the steering wheel effort. Instead of the hydraulic system requiring constant flow rate, this steering system has a substantially lesser control flow rate and produces its operating condition flow rate only as required by control exercised and applied by steering effort. This objective is realized in a second servo-control having a valve spool with a cam surface which, upon being rotated by the steering wheel, produces an increase in control pressure that operates to force the pumping ring to an eccentric position. When the steering effort is relaxed the control pressure is reduced and the pumping ring is moved to a concentric position corresponding to the minimum flow rate of the power steering system.

DESCRIPTION OF THE PREFERRED EMBODIMENT

Figure 1:
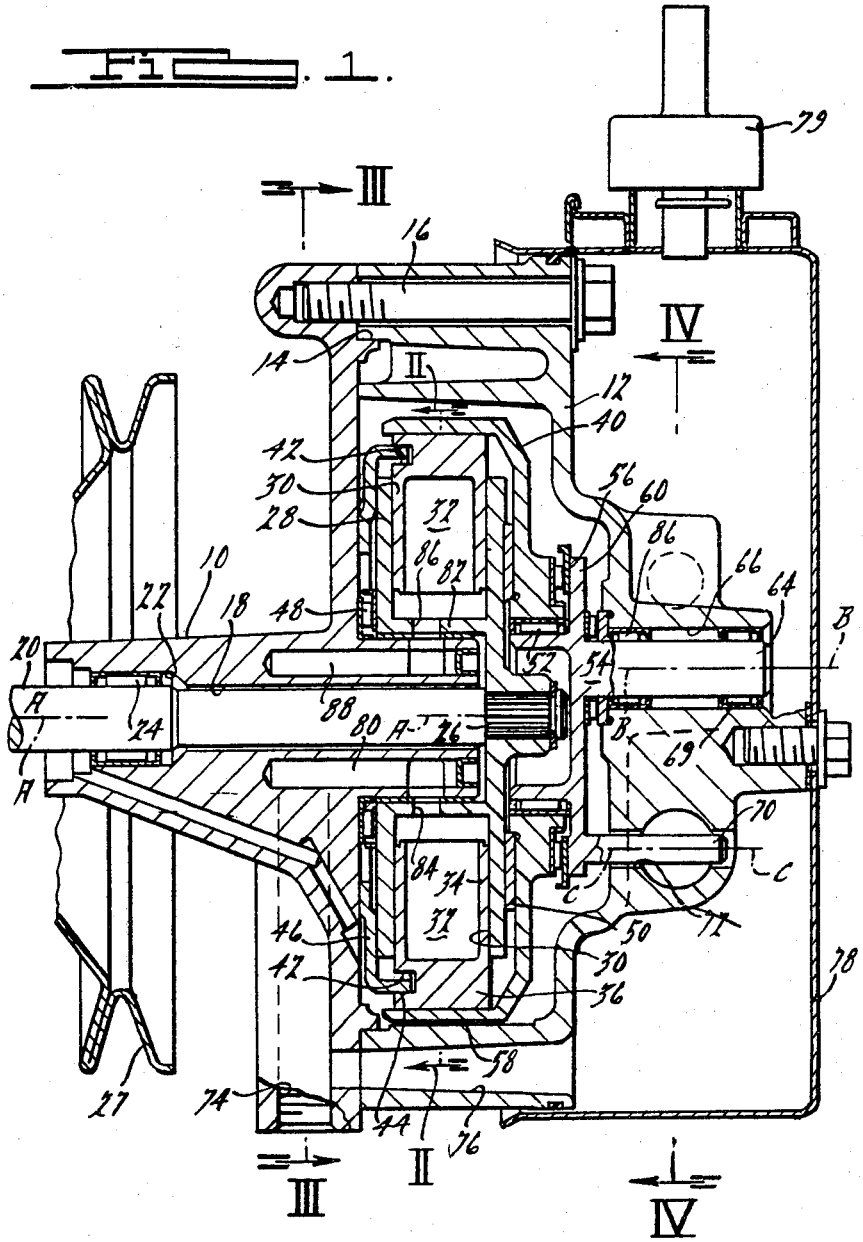
FIG. 1 is a diametrical cross section of a rotary piston pump according to my invention showing the pump in the destroke position, wherein the eccentric has caused the pumping ring to be aligned with the shaft axis.

With reference first to FIG. 1, a radial piston pump made according to this invention includes a first housing 10 and a second housing 12 that are mutually aligned with the central axis A—A by way of a lead surface 14 upon which the housing 12 rests. The housings 10, 12 are mechanically joined by attachment bolts 16 that engage the tapped threads formed by the housing 10 that are distributed around the periphery of the housings. Bore 18 extends axially in the housing 10 and provides a space wherein a rotor shaft 20 is fitted. The recess 22 is formed in the housing 10 and receives the needle bearings 24 which journal the shaft to the housing. The end of the shaft that extends outwardly from the housing has a pulley 27 attached, which is driven from the crankshaft of the engine. At the opposite end of the shaft, integral external splines 26 mate with the internal splines of a rotor 28 whereby the rotor is driven in rotation by the engine.

Figure 2:
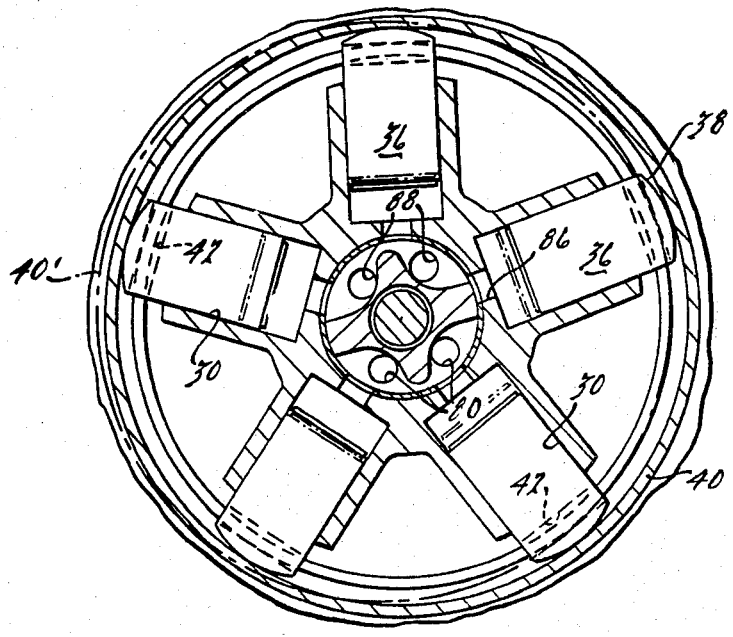
FIG. 2 is a lateral cross section taken at plane 2—2 of FIG. 1 showing the pistons fitted within the cylinders and abutting the pumping ring at a destroke and onstroke position.

The rotor defines five radially directed cylinders 30 into which the pistons 32 are slidably fitted for radial motion therein. The pistons 32 have a central cylindrically shaped bore 34 that extends partially along the radial extent of the piston and terminates at a piston head portion 36. As best seen in FIG. 2, the radially outermost contour of the piston head 36 has a cylindrical contour 38 that produces a line contact with the inner surface of a pumping ring 40 with which it is continually held in sliding contact. The notch 42, directed transversely of the central axis of the piston, is formed in the head portion 36 and receives an axially extending flange 44 formed on the suction ring 46. One axial face of the rotor 28 faces the inner surface of the housing 10 and the opposite axial surface of the rotor is spaced from an inner surface of the pumping ring 40 by a thrust washer 50.

The pumping ring 40 is supported on the needle bearing 52 that is journalled on the cylindrical hub 62 of an eccentric 54. The ring 40 is further supported on a disc face 60 of the eccentric 54 by the needle thrust bearing 56 that is interposed between the eccentric and a central collar portion of the pumping ring 40. An axially extending annular flange 58 at the periphery of the pumping ring is overhung from the hub portion of the pumping ring and furnishes an inner guide surface with which the outer cylindrical contour of the pistons 32 is held in contact.

The eccentric 54 includes a disc portion 60 from which the central hub 62 extends axially and upon which the pumping ring 40 is journalled by the bearing 52. On the opposite side of the disc 60, a crankpin 64 extends axially and is supported within the bore 66 of the housing 12 by the needle bearings 68, 69. It should be noted that the axis of the crankpin B—B axis is eccentric of the axis A—A of the rotor shaft 20. Also extending axially from the surface of the disc portion of the eccentric 54 is an actuator pin 70 having a central axis C—C. The actuator pin 70 is fitted within an arcuate slot 72 formed in the outer face of the housing 12.

Within the central space of the housing 12 at the opposite side of the rotor 28, the suction ring 46 is seen to engage the notches 42 formed in the pistons 32. The suction ring is unsupported within the housing except for contact with the notches 42. The effect of the suction ring 46 is to force all the pistons to move in the cylinders as a single unit and to synchronize their motion such that when a piston is located at the radially outermost ends of the cylinders the pistons on the opposite side of the rotor center A—A are drawn up to the inner end of their respective cylinders.

The housing 10 has a radially directed suction port 74 that is intersected by an axially extending suction port 76 which is formed through housings 10, 12 and connects the hydraulic fluid tank 78 to the inlet suction port 74. The tank 78 is mounted over the outer surface of the housing 12 and includes a filler cap 79 that can be removed to fill the tank from an external source. The axial suction port 76 communicates with two axially directed suction ducts 80 that carry inlet hydraulic fluid either from the tank 78 through the suction duct 76 or from an external source from which the fluid is directed to the pump by way of the suction port 74. The cylindrical hub portion 82 of the rotor 28 has a plurality of radially directed passages 84 formed therethrough which provide means for carrying the suction hydraulic fluid from the suction port 74, 75 to each of the cylinders 30 as the rotor turns the passages 84 into alignment with the suction duct 80.

Figure 3:
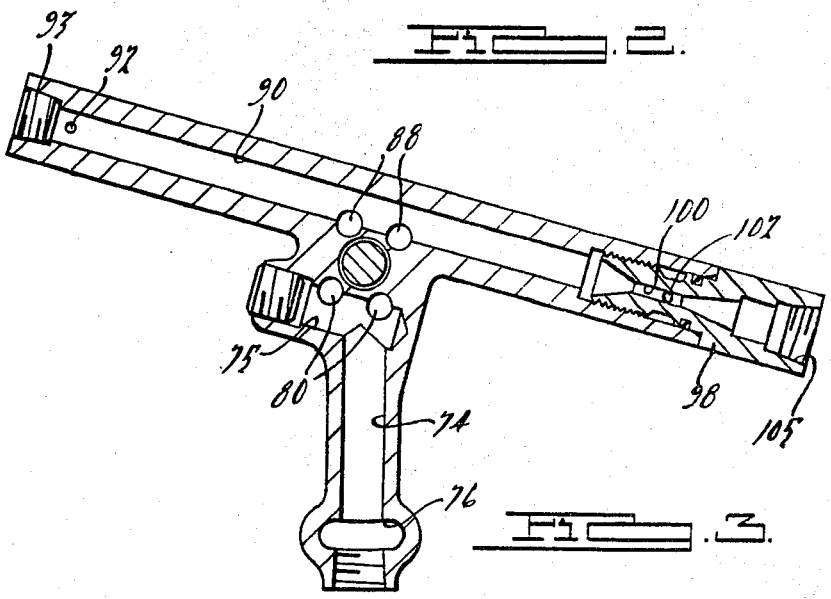
FIG. 3 is a cross section taken at plane 3—3 of FIG. 1 through the center line of the discharged port showing the venturi orifice positioned in the discharged port and the suction duct for carrying hydraulic fluid to the rotor.

Hydraulic fluid is pumped from the cylinders 30 through the radial passages 86 that are formed in the hub portion of the rotor 28 on the opposite side of the central axis A—A from that of the radial passage 84. The pressurized hydraulic fluid flows into the axially directed discharge ducts 88 which carries the fluid into the discharge port 90, as best seen in FIG. 3. The discharge port 90 is directed along a chordal line of the cylindrical housing 10. A fluid tight plug may be threaded into the end of the exit port 90 at the threads 93 in order to seal the end of the port 90. At that axial end of the port 90, a duct 92 carries pressurized hydraulic fluid to the axially opposite end of the pump and communicates with an intersecting duct 94 that delivers the pressurized fluid to a flow control valve assembly shown generally at 96 in FIG. 4. At the axially opposite end of the discharge port 90 from the location of the duct 92, a venturi metering orifice 98 is mechanically mounted within the discharge port 90. The metering orifice 98 includes a throat portion 100 whose cross-sectional area is closely established to produce a pressure drop within the discharge port 90 that corresponds with the desired maximum fluid rate of the pump. For example, when this pump is used in the power steering system of an automobile, the cross-sectional area of the throat 100 is sized to produce a pressure drop corresponding to two gallons per minute of flow through the discharge port 90. A duct 102 intersects with the metering orifice 98 in its throat portion and furnishes a port through which the static pressure in the throat is applied to the flow control valve 96. The duct 102 extends axially in general parallel relationship to the duct 92 and carries hydraulic fluid rearwardly toward the flow control valve assembly 96. The outer end of the venturi metering orifice 98 has a fluid coupling fitted in the tapped threads 105 to carry the fluid to the hydraulic circuit.

Figure 4:
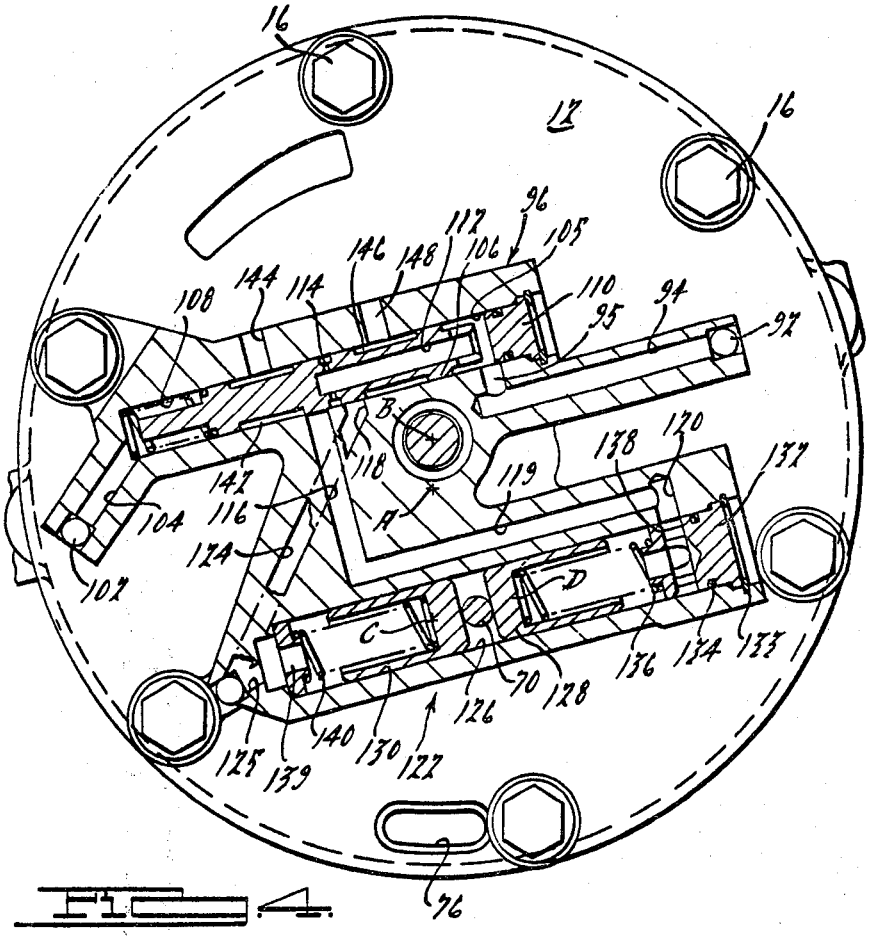
FIG. 4 is a cross section taken at plane 4—4 of FIG. 1 through the center lines of the flow control valve assembly and the control piston arrangement showing the related hydraulic porting. The actuator pin and control pistons are, however, in an intermediate position rather than in the destroke position of FIG. 1.

Referring now to FIG. 4, the axially extending duct 102 communicates with an intersecting duct 104, which communicates the hydraulic fluid from the orifice of the venturi meter 98 to the flow control valve assembly 96. The flow control valve assembly includes a central bore 105 that is drilled through a thickened portion on the rearward face of the cast housing 12. A valve spool 106 is fitted within the bore and is capable of sliding along its central axis between the plug 110, which seals off the external end of the bore, and a spring 108 fitted within the bore at the opposite end. The spring 108 applies a force to the spool 106 that biases the face of the spool into contact with the plug 110. A central bore 112 extending partially along the central axis of the spool 106 has radially extending holes 114 near its inner terminal end. Hydraulic fluid at discharge pressure is, therefore, carried by the ducts 92, 94, 95 and is admitted to the bore 105 of the control valve assembly 96 at the right end of the bore. At the other end, hydraulic fluid at the static pressure of the venturi orifice is carried by the ducts 102, 104 and admitted to the bore 105 at the left end of the control valve assembly.

The radial holes 114, by reason of the sliding motion of the valve spool 106, are brought into general alignment with either of the ports 116 or 118. The port 116 communicates with the ports 119, 120, which together provide a path for the fluid to flow from the bore 105 of the flow control valve assembly 96 to the control piston assembly shown generally at 122. Similarly, the port 118 communicates with the control piston assembly 122 by way of the intermediate ports 124, 125.

Like the flow control valve assembly 96, the control piston assembly is formed in the thickened portion on the rearward face of the cast housing 12. A bore 126 receives a a first control piston 128 in its right end, as shown in FIG. 4, and a second control piston 130 in its left end. The external end of the bore 126 is sealed by a plug 132, which is fixed in position by a retaining ring 133 and sealed by the O-ring 134. The compression spring 136 is nested within a recess formed in the piston 128 and bears upon the surface of the plug 138 located within the bore 126. The plug 138 is prevented from interferring with flow through the port 120 by a surface extending from the plug 132. The control piston 130 similarly furnishes a recess into which a compression spring 140 is fitted which bears upon a second plug 139 located within the bore 126. The pistons 128 and 130 are positioned within the bore 126 in opposed arrangement and mutually engage the diametrically opposite surfaces of the cylindrical actuator pin 70 that extends through the arcuate slot 72 into the cylinder 126.

Figure 5:
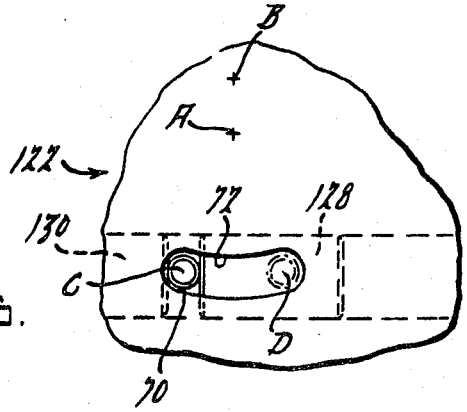
FIG. 5 is a partial cross section through the center line of the control piston cylinder similar to that shown in FIG. 4, but instead showing the pistons contacting the actuator pin when the pin is in the destroke position.

FIG. 5 shows the actuator pin 70 in the destroke position at point C where the opposed control pistons 130, 128 are biased by their respective compression springs 136, 140 and the hydraulic pressure existing in one end of the cylinder 126. In FIG. 5, point B represents an end view of the axis B—B, which is the axis about which the eccentric 54 pivots; point C represents the axis of the actuator pin 70 when it is positioned within the arcuate slot 72 at the destroke position; point D represents the axis of the actuator pin 70 when it is in the maximum pumping position. Point C and Point D are the extremities between which the eccentric 54 may pivot about the axis B—B. Because the pumping ring 40 is journalled on the eccentric 54, it pivots about the axis B—B as the actuator pin is displaced by the action of control piston 128 or 130.

FIG. 2 illustrates the extremities of the movement of the pumping ring 40 from the destroke position, shown in solid lines, to the maximum pumping position, shown in dashed lines at 40'. The effect of the pivoting of the eccentric 54 is to displace the pumping ring between these extremities. The pistons 32 maintain sliding contact with the inner surface of the pumping ring flange because centrifugal force causes the pistons to slide outwardly within the cylinders 30 as the rotor 28 is driven by the shaft 20. When the pumping ring is in the destroke position shown at 40 in FIG. 2, it can be seen that the pistons 32 do not move within the cylinder 30; therefore, there is no displacement of the hydraulic fluid and the hydraulic system is depressurized. However, when the pumping ring is moved by the force of the control pistons 128, 130 acting upon the actuator pin 70 to the maximum pumping condition shown at 40' in FIG. 2, the pistons 32 are seen to move within the cylinders 30 between the extremes of the radially outermost position, at the left side of the rotor, to the radially innermost position, at the right side of the rotor. As the rotor shaft 20 is driven by the engine, centrifugal force causes the pistons 32 to follow the guide path furnished by the interior surface of flange 58. The greater the extent of the sliding motion of the piston within the cylinder 30, the more fluid is displaced and the hydraulic system is pressurized accordingly.

The pumping ring 40, although not mechanically attached to either the rotor 28 or the rotor shaft 20, will nonetheless rotate at substantially an identical speed by reason of engagement of the outer surfaces of the pistons on the guide surface of the pumping ring. The suction ring 46 operates to positively displace the pistons outwardly in the cylinders during the suction portion of the rotor path. Although the pistons tend to be driven outwardly by the operation of centrifugal force, at low rotor speed frictional force operates to overcome the effects of centrifugual force. The pistons have a tendency, then, to remain at the inner end of the cylinders. Therefore, as the pistons on the discharge side of the rotor are moved inwardly as the result of the contact of the pistons on the guide surface of the pumping ring the suction ring 46 transmits that motion to the pistons on the suction side of the rotor thereby causing those pistons to maintain contact with the pumping ring. This action is particularly important at idle speed where the centrifugal force is insufficient to cause the pistons to slide outwardly during the suction portion of the rotor cycle. In addition, the suction ring is effective in preventing rotation of the pistons within the cylinders because the flange 44 of the suction ring 46 bottoms in the slots 42 of the pistons 32. The suction ring floats axially and radially and rotates at substantially the same speed as the rotor. Sliding motion between the piston and the suction ring and between the pistons and the pumping ring is limited to slight differences in tangential velocity. These velocity differences approach zero when the pump is disposed for minimum stroke and the effect of this is to minimize friction and wear between the mating parts.

The hydraulic control for regulating discharge flow from the radial piston pump limits the flow to a predetermined flow rate and causes the pump to destroke above idle speed, thereby tending to require a constant level of power to drive the pump regardless of the rotational speed of the engine. In operation, the hydraulic control operates by passing the entire quantity of hydraulic fluid discharged from the cylinders of the pump to the discharge ducts 88, which communicate with the discharge port 90 in the forward face of the housing 10. The entire volume of hydraulic fluid displaced by the pump flows in the discharge port 90 through the venturi orifice 98 and exits the pump through the port 102. The position of the pumping ring 40 in relation to the rotor 28 is determined by the control exercised over the actuating pin 70 by the control pistons 128, 130.

In regulating the flow rate of the pump at the fixed volume rate, hydraulic fluid at discharge pressure is communicated by the ducts 92, 94, 95 to one side of the valve spool 106 located within the bore 105 of the control valve assembly 96. A balancing pressure is applied to the opposite end of the valve spool 106 by the hydraulic pressure ported from the throat of the venturi orifice 98 by way of the ducts 102, 104 which ultimately lead to the bore 105.

The size of the venturi throat establishes a predetermined differential pressure across the valve spool 106, which differential pressure corresponds to the desired flow rate of the pump. When the flow rate decreases below the predetermined rate, the resultant of the oppositely directed forces it produces on the valve spool combines with the force developed by the spring 108, which is applied to the venturi side of the valve spool 106. When this occurs, the valve spool 106 moves within the bore 105 bringing the radial holes 114 into general alignment with the port 118. This action opens communication between the static pressure in the orifice 100 and the left hand of the control piston 130 by way of the ducts 118, 124, 125. Control piston 130 is displaced within the cylinder 126 to the right, shown in FIG. 4, and this movement causes the actuator pin 70 to move in that direction as well. Consequently, the eccentric 54 is caused to rotate about its axis B—B and the pumping ring 40 is moved toward the position shown at 40' in FIG. 2. This action has the effect of increasing the pump stroke by an amount that depends upon the difference of the differential pressure present on the opposite sides of the spool 106. Cylinder 126 is not pressurized on the side occupied by the control piston 128 in the destroke position described because when the radial holes 114 of the valve spool 106 are brought into alignment with the duct 118 the duct 116 that communicates with control cylinder 126 is exposed to the ambient conditions of the hydraulic fluid tank 78. The recesses 142 on the spool 106 communicate the duct 116 with the tank 78 through the port 144.

When the flow rate of the pump exceeds the predetermined flow rate limit, the resultant of the oppositely directed forces it produces on the valve spool overcomes the effect of the spring 108 and causes the valve spool to be displaced within the bore 105 until the radial holes 114 are brought into general alignment with the port 116. When this occurs, hydraulic fluid at discharge pressure flows through the central bore 112 of the spool 106, through the radial holes 114, into the ports 116, 119, 120, and is applied to the piston 128 within the control cylinder 126. In this instance, the recesses 146 on the valve spool 106 communicate with port 118 through the tank port 148. Therefore, the control cylinder 126 has ambient tank pressure applied behind the control piston 130. The effect of this is to cause the control piston 128 to move leftwardly within the cylinder 126 thereby forcing the actuator pin 70 to be displaced in that direction. The eccentric 54 is rotated about its axis B—B and the pumping ring 40 is moved toward the position shown in FIG. 2 as indicated at 40. In this way the pump is destroked and the discharge flow rate reduced.

Figures 6, 7:
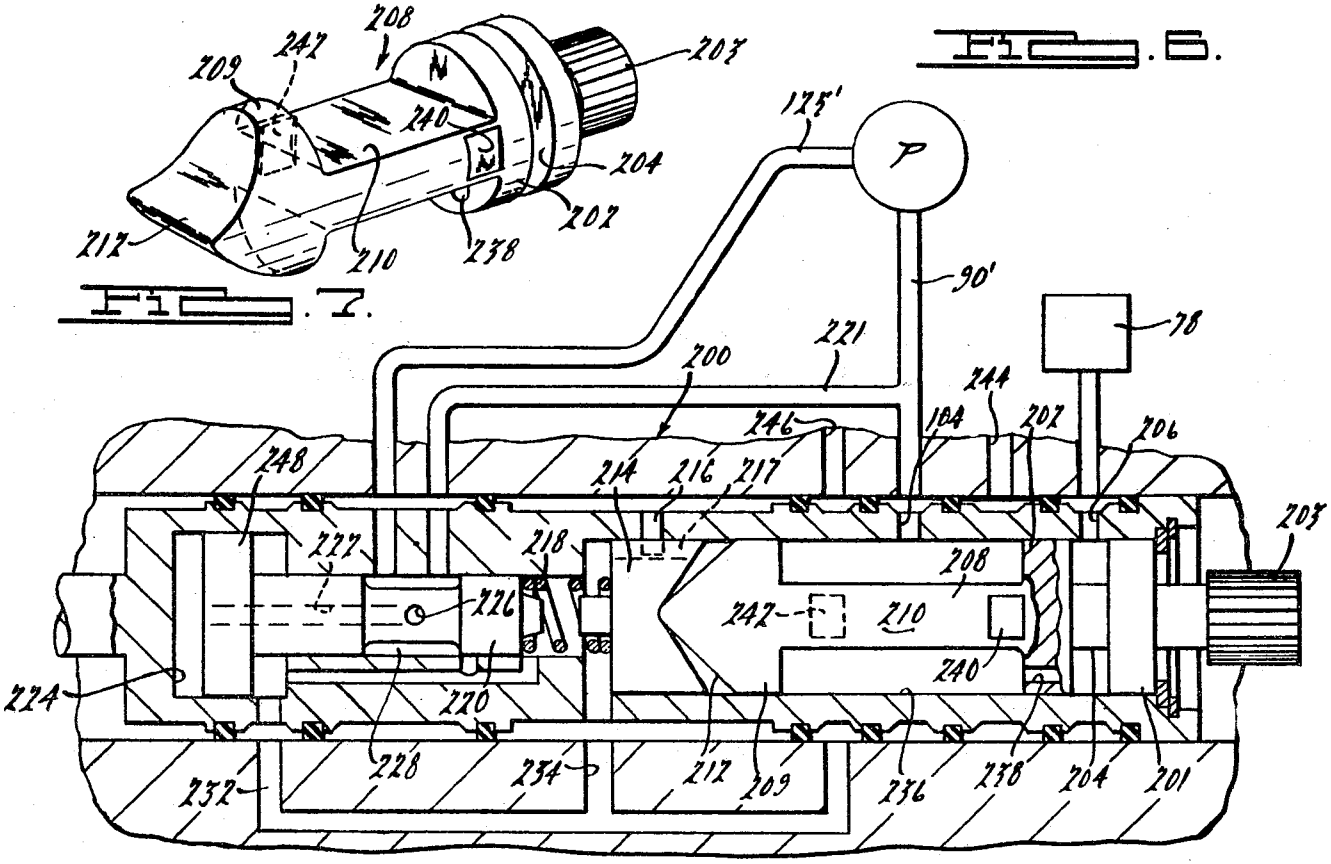
FIG. 6 is an axial cross sectional view of a minimum flow control valve and the associated porting that can be used to regulate the flow rate and discharge pressure of the radial piston pump according to the requirements of a power steering system.
FIG. 7 is a perspective view of the minimum flow control left-right turn valve shown in FIG. 6.

A second control valve assembly 200 shown in FIGS. 6 and 7, operates to regulate the radial piston pump according to my invention in response to the pressure requirements of a power steering hydraulic system of an automotive vehicle. The second flow control valve 200 generally replaces the flow control valve assembly 96 and functions to regulate control pressure according to the magnitude of torque that is applied to the steering wheel. In this device torque applied to the steering wheel by the motor vehicle operator is transmitted to the input shaft 203 that includes inner and outer circular flanges 201, 202 having an annular recess 204 therebetween. A connection is made between the recess 204 and the hydraulic fluid tank 78 by way of the port 206 that extends radially through the thickness of the control valve 200. A turn valve 208 is integrally formed with the flanges 201, 202 and includes a center portion 210 having an outer cylindrical surface whose diameter is equal to the diameter of the flanges 201, 202 and the diameter of the flange 209 located at the opposite axial end from the flanges 201, 202. A conical cam surface 212 is formed on the terminal end of the turn valve 208, which surface engages a complementary surface on a cam follower 214 that is mounted within the bore of the control valve 200. Its motion is guided therein by the guide pin 216, which is fixed to the valve body and is fitted within the axial recess 217 and prevents rotation of the cam follower 214 with respect to the valve 200. A mechanical compression spring 218 is seated on the face of the cam follower 214 and engages, at its axially opposite end, the face of a control valve spool 220, which is aligned with the axis of the control valve 208. The valve spool 220 has a central bore 222 that extends partially along its length and hydraulically connects the cylinder 224 with a radially directed port 226. An annular recess 228 formed in the outer surface of the spool 220 communicates the radial port 226 with the control pressure duct 125' that leads back to the flow control piston assembly 122. The connection with the piston assembly 122 is represented by reference number 125', which corresponds to the port 125 of the control piston assembly 122, previously described. Pressurized fluid at discharge pressure is carried directly to the control piston assembly 122 through port 120 which is positioned on the pump as previously described. Port 120 communicates fluid directly from the discharge duct 88 to the control piston assembly 122, since the flow control valve assembly 96 is not used in this embodiment. Duct 221 carries discharge fluid to the recess 228.

The inner end of the cylinder 224 communicates with the tank 78 through the port 232. The space between the opposed faces of the cam follower 214 and the valve spool 220 is vented to tank through the port 234. The space 236 on one side of the center portion 210 is vented to tank by way of the duct 238 that communicates with the annular recess 204. On a diametrically opposite side of the center portion 210, hydraulic fluid at pump discharge pressure is delivered to the space 237 through the duct 104'. A transverse notch 240 is formed across the upper cylindrical surface of the center portion 210 and a second transverse notch 242 is formed across the lower cylindrical surface of the center portion 210, each notch serving to communicate hydraulic fluid at a low rate of flow between the spaces 236 and 237. Furthermore, as torque is applied to the input shaft 203 in the clockwise direction when viewing the control valve in the direction 8 of FIG. 6, the transverse notch 240 is rotated into communication with the right turn hydraulic port 244 formed through the wall thickness of the control valve 200. This clockwise motion has the effect of displacing the notch 242 and preventing connection of hydraulic fluid to the left turn port 246 that is similarly formed through the wall thickness of the control valve 200. However, the connection between the discharge pressure of the pump continues because the transverse notch 242 communicates the space 236 with the space 237.

When torque is applied to the input shaft 203 in a counterclockwise direction when viewed in direction 8, the transverse notch 242 is rotated into communication with the left turn port 246 and the transverse notch 240 is rotated away from communication with the right turn port 244. The notch 240, however, provides communication between the spaces 236, 237.

The cylinder 224 is separated by the piston 248 from the connection to tank previously described. A supply of hydraulic fluid is supplied to the terminal end of the cylinder 224 by port 221 where changes in its pressure due to movement of piston 248 operate to regulate the position of the actuator pin 70.

In operation, when the input shaft 203 is rotated either clockwise or counterclockwise, the cam surface 212 rotates into contact with the follower surface 214 and causes the follower to move axially in the direction of the cylinder 224; thereby compressing the spring 218. The spool 220 moves the piston 248 axially within the cylinder 224 and the duct 221 is closed off from the recess 228. The hydraulic fluid present in the cylinder 224 is pressurized causing application of control pressure to the end of the control piston assembly 122 by way of duct 125'. The position of actuator pin 70 is therefore controlled by the opposing pressure forces applied to control pistons 128 and 130. Control pressure from chamber 224 applied via duct 125 to piston 130 tends to move pin 70 in the direction that causes an increase in pump stroke. Discharge pressure applied via duct 120 to piston 128 tends to move pin 70 in the direction that causes the decrease in pump stroke. When there is no effort applied to the steering wheel, the valve maintains a flow rate through the hydraulic system whose magnitude is controlled by the size of the opening existing between the surfaces of the transverse notches 240, 242 and the inner cylindrical surface of the control valve bore that bounds the spaces 236, 237.

Having thus described a preferred embodiment of this invention, what is claimed and desired to secure by the U.S. Letters Patent is:

1. A hydraulic fluid pump for producing a constant flow rate comprising:

a rotor mounted for rotation about a first axis having multiple cylinders circumferentially spaced around and radially directed from the first axis and a piston slidably working in each cylinder;

means defining a first space extending over a first angular portion of the rotor, communicating a source of fluid with the cylinders and defining a second space extending over a second angular portion of the rotor communicating the cylinders with a passage that carries fluid from the cylinders;

an eccentric pivotably mounted on a second axis eccentric of the first axis providing a support hub having an arcuately movable actuator pin spaced radially from the second axis for pivoting the support hub into and out of alignment with the first axis;

a pumping ring having a guide surface with which the pistons maintain contact during rotation of the rotor, rotatably supported on the hub of the eccentric whereby the axis of the pumping ring pivots about the second axis into and out of alignment with the first axis as the eccentric pivots;

control piston means operative in response to the application of control pressure to a first control piston to pivot the actuator pin about the second axis and thereby to increase the eccentricity between the axis of the pumping ring and the first axis thus increasing the flow rate of the pump and operative in response to the application of control pressure to a second control to pivot the actuator pin about the second axis and thereby to decrease said eccentricity thus decreasing the flow rate; and means operative in response to a differential fluid pressure corresponding to a predetermined pump flow rate for directing control pressure to one or the other of said control pistons.

2. The pump according to claim 1 wherein the pumping ring is mounted on the eccentric at one axial end of the rotor.

3. The pump according to claim 1 wherein the rotor includes a port located at the radially inner end of each cylinder communicating sequentially with the first and second spaces as the rotor rotates, whereby fluid enters the cylinders through the ports during the portion of the rotor cycle when the ports communicate with the first space and fluid exits the cylinders through the ports during a second portion of the rotor cycle when the ports communicate with the second space.

4. The pump according to claim 1 wherein the control pressure directing means includes:

a constricted passage through which fluid discharged from the pump flows;

a valve spool slidably mounted within a valve bore having fluid at pump discharge pressure applied to one end thereof biasing the valve spool to a first end of the bore and fluid at the pressure within the constricted passage applied to the opposite end thereof biasing the valve spool to a second end of the bore; and passage means for hydraulically connecting fluid at pump discharge pressure that is applied to one end of the valve spool to the first control piston when the spool is moved toward the first bore end and to the second control piston when the spool is moved toward the second bore end.

5. The pump according to claim 1 wherein the radially outer ends of the cylinders are open the pistons have a head portion extending beyond the radially outer ends of the cylinders, each head portion having a slot formed therein, the pump further comprising a suction ring having a flange engaging each slot.

* * * * *